US010018204B2

(12) United States Patent
Hong et al.

(10) Patent No.: US 10,018,204 B2
(45) Date of Patent: Jul. 10, 2018

(54) FAN AND FAN MODULE

(71) Applicant: Brose Fahrzeugteile GmbH & Co. KG, Wuerzburg, Wuerzburg (DE)

(72) Inventors: Tao Hong, Farmington Hills, MI (US); Derek Mudge, Dearborn Heights, MI (US)

(73) Assignee: BROSE FAHRZEUGTEILE GMBH & CO. KG, WUERZBURG, Wuerzburg (DE)

( * ) Notice: Subject to any disclaimer, the term of this patent is extended or adjusted under 35 U.S.C. 154(b) by 329 days.

(21) Appl. No.: 14/956,566

(22) Filed: Dec. 2, 2015

(65) Prior Publication Data

US 2017/0159543 A1 Jun. 8, 2017

(51) Int. Cl.
*F04D 29/38* (2006.01)

(52) U.S. Cl.
CPC ..... *F04D 29/384* (2013.01)

(58) Field of Classification Search
CPC ..... F04D 29/38; F04D 29/384; F04D 29/386; F04D 29/326; F04D 19/002
See application file for complete search history.

(56) References Cited

U.S. PATENT DOCUMENTS 5,064,345 A * 11/1991 Kimball ..... F04D 29/386 416/169 A
5,906,179 A * 5/1999 Capdevila ..... F04D 29/326 123/41.49

FOREIGN PATENT DOCUMENTS

EP 0 500 782 B1 7/1995

* cited by examiner

*Primary Examiner* — Logan Kraft
*Assistant Examiner* — Sabbir Hasan
(74) *Attorney, Agent, or Firm* — Westman, Champlin & Koehler, P.A.

(57) ABSTRACT

The invention relates to a fan and a fan module, wherein the fan comprises: a fan hub which comprises a fan rotation axis to rotate in a predetermined direction, a plurality of fan blades comprising a lower end and an upper end, wherein each fan blade is attached with its lower end to the fan hub and extends radially outwardly from the fan hub, wherein each fan blade comprises a lower back sweep portion and an upper forward sweep portion, wherein a maximum ratio r/R of the lower back sweep portion is at least 0.90, wherein r is the local radius of a point of the fan blade edge, and R is the radius of the upper end of the fan blade.

18 Claims, 2 Drawing Sheets

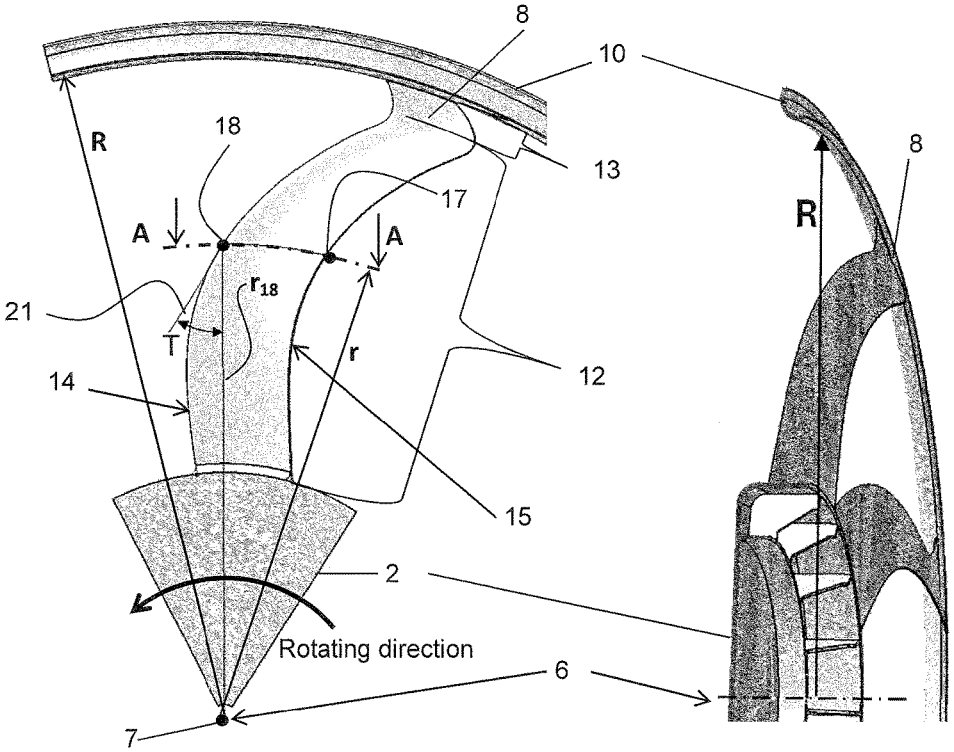
Fig. 3a
Fig. 3b
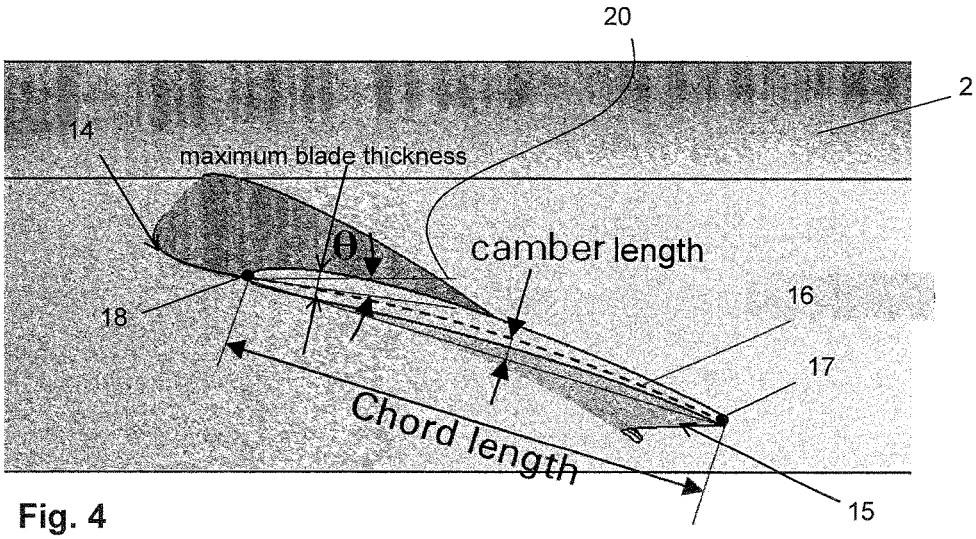
Fig. 4

FAN AND FAN MODULE

FIELD OF THE INVENTION

The present invention relates to a fan and a fan module, in particular a cooling fan module in the automotive field, e.g., for a motor vehicle.

TECHNICAL BACKGROUND

Fan modules such as cooling fan modules are generally used to cool the engine in motor vehicles. Generally a fan module consists of a fan, a motor located at the centre of the fan to drive the fan, and a frame which comprises assembly struts for fixing the motor. Further, the fan of a cooling fan module is designed to produce an air flow with which the heat generated by the engine is removed.

As a fan of the fan module, in particular cooling fan module, a forward sweep fan or a back sweep fan are commonly used. Comparing with a forward sweep fan, a back sweep fan of a cooling fan module of a vehicle has good efficiency over a wider operating range and higher pressure rise at high flow rate, which is needed, when vehicle is under trailer towing condition at 50 to 60 mile per hour speed or 80.47 km/h to 96.56 km/h when a heat rejection rate from the engine of the vehicle is very high. But in general back sweep fan creates more noise than comparable forward sweep fan.

EP 0 500 782 B1 describes a fan comprising multi-sweep blades with abrupt sweep transition. According to EP 0 500 782 B1 the blades are rearward swept inner blades and are formed with a very high forward sweep at the tip.

SUMMARY OF THE INVENTION

Against this background, there is a need to provide an improved fan and a fan module comprising said fan, in particular a cooling fan module for a motor vehicle.

Accordingly, a fan is provided, comprising: a fan hub which comprises a rotation axis to rotate in a predetermined direction, a plurality of fan blades comprising a lower end and an upper end, wherein each fan blade is attached with its lower end to the fan hub and extends radially outwardly from the fan hub, wherein each fan blade comprises a lower back sweep portion and an upper forward sweep portion, wherein a maximum ratio r/R of the lower back sweep portion is at least r/R=0.90, wherein r is the local radius of a point of the fan blade edge, and R is the radius of the upper end of the fan blade.

Since the maximum ratio r/R of the lower back sweep portion of the fan blade is at least r/R=0.90 and further the fan blade comprises in addition to the lower back sweep portion an upper forward sweep portion it is possible to reduce fan noise and still keep high performance of a typical back sweep fan. Therefore a fan with a better performance, higher efficiency and lower noise level can be provided.

Embodiments and developments of the invention emerge from the additional subordinate claims and from the description with reference to the drawing figures.

According to an embodiment of the invention the maximum ratio r/R of the lower back sweep portion less than or equal 0.95 and preferably less or equal 0.956.

Further, according to another embodiment of the invention, the ratio r/R of each fan blade is between 0.3 and 1.00 and preferably between 0.373 and 1.00.

In an embodiment of the invention the maximum sweep angle T of the leading edge of the fan blade is at least 50° or preferably 51.6° and/or the minimum sweep angle T of the leading edge of the fan blade is at least −2.0° and preferably −2.7°. The sweep angle T is the angle between a radial line through a point of the fan blade leading edge at the radial location r or local radius r and a tangent to the leading edge at said point.

According to a further embodiment of the invention, in the forward sweep region the sweep angle T of the leading edge of the fan blade ranges between T≤0° and T=−35.6°, and wherein the ratio r/R of the forward sweep region is preferably between equal or larger than 0.956 and 1.00.

In another embodiment of the invention, the ratio of the maximum blade thickness/chord length of the fan blade increases with increasing ratio r/R and ranges from 0.069 to 0.111, wherein the ratio of the maximum blade thickness/chord length of the fan blade is 0.111 at the upper end of the fan blade, wherein the chord length is the distance between the point of the fan blade leading edge and the point of the fan blade trailing edge at the radial location r or local radius r, and the maximum blade thickness is the maximum thickness of the fan blade at the radial location r or local radius r.

In an embodiment of the invention the ratio of the camber length/chord length of the fan blade decreases from 0.053 to 0.041 from the lower end to the upper end of the fan blade, wherein the camber length is the maximum distance between chord and mean line at the radial location r or local radius r.

According to an embodiment of the invention a blade angle θ of the fan blade decreases with increasing ratio r/R, wherein the blade angle is at least −16° and preferably −16.2° at the upper end of the fan blade and/or at least 16° at the lower end of the fan blade and preferably 16.4°. Further, the blade angle θ is the angle between a mean line of the fan blade and a plane which is perpendicular to the rotation axis of the fan, wherein the mean line and the plane intersect at the point of the fan blade leading edge at the radial location r or local radius r.

In an embodiment of the invention the fan comprises a fan ring connecting the fan blades at their upper end.

CONTENT OF THE DRAWINGS

The present invention is explained below in greater detail with the aid of embodiments specified in the schematic figures in the drawings. These are as follows.

Figure 2:
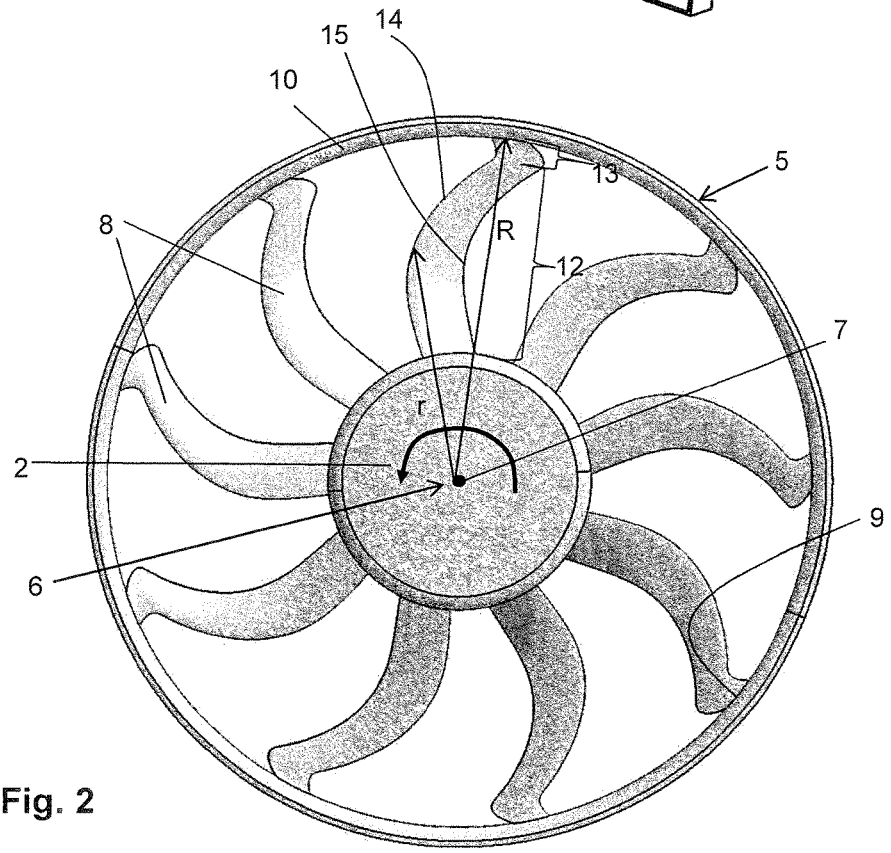
FIG. 2 shows a front view of a fan according to an embodiment of the invention.

FIG. 3*a* shows a fan blade of the fan according to FIG. 2;

FIG. 3*b* shows a cross-section of the fan of FIG. 2 in a perspective side view; and FIG. 4 shows cross-section A-A of the fan blade of FIG. 3*a*.

The accompanying drawings should convey further understanding of the embodiments of the invention. They illustrate embodiments of the invention and clarify the principles and concepts behind the invention in conjunction with the description. Other embodiments and many of the described advantages are apparent with respect to the drawings. The elements of the drawings are not necessarily illustrated true to scale in relation to each other.

In the figures in the drawing, the same elements, features and components, or those serving the same function and having the same effect, are provided with the same reference numerals in each case—unless otherwise specified.

DESCRIPTION OF EMBODIMENTS

Figure 1:
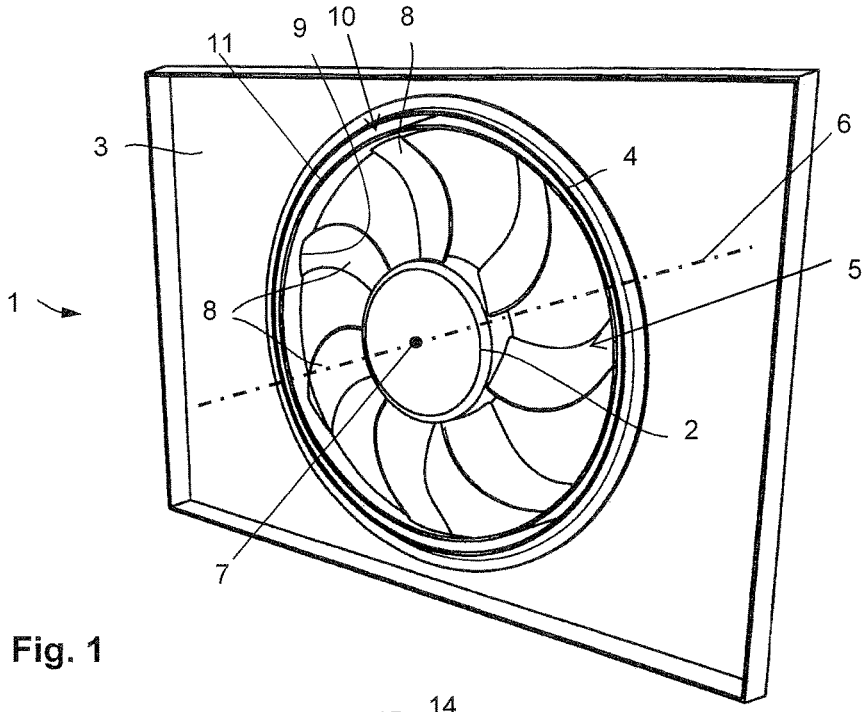
FIG. 1 shows a perspective front view of a fan module comprising a conventional fan.

FIG. 1 shows a perspective front view of an exemplary cooling fan module 1 for a vehicle. The cooling fan module 1 comprises a frame 3 provided with an opening 4 on which a fan 5 is located.

In FIG. 1 a conventional fan 5 is shown to be replaced by an inventive fan which will be described in the following with respect to FIGS. 2 to 4.

The fan 5 is fixed to a motor shaft, and the motor (not shown in FIG. 1) is located inside a fan hub 2 and fixed to the frame 3 by assembly means, e.g. struts etc., not shown in FIG. 1. The fan 5 can rotate around a rotation axis 6 by means of the motor shaft rotating inside the motor. The center 7 of the fan 5 and the rotation axis 6 of the fan 5 are indicated in FIG. 1.

Furthermore, the fan 5, in particular an axial fan, comprises a plurality of fan blades 8. The fan blades 8 in FIG. 1 are crescent-shaped toward the rear.

The fan blades 8 are attached at their lower end to the fan hub 2 and are further connected to one another at their upper end or tip 9 via an outer fan ring 10. The fan ring 10 is located between the fan 5 and the frame 3 as shown in FIG. 1. An air gap 11 is provided between the fan ring 10 and the frame 3, the recirculating airflow of the cooling fan module 1 flows through said air gap 11. The fan illustrated in FIG. 1 is, e.g. a back sweep fan.

In FIG. 2 a front view of an inventive fan 5 is shown according to an embodiment of the invention. The inventive fan 5 as shown in FIG. 2 can be used for example with the fan module described before with respect to FIG. 1. However, the inventive fan 5 is not limited to the particular fan module shown in FIG. 1 but can be used in any kind of fan module, in particular a cooling fan module of a vehicle, which is suitable to be used with the inventive fan 5. Further, FIG. 3*a* shows one of the fan blades 8 of the inventive fan 5 of FIG. 2. In this connection FIG. 3*b* shows a cross-section of the fan of FIG. 2 in a perspective side view. Moreover, FIG. 4 shows a cross-section of the fan blade of FIG. 3*a*.

The inventive fan 5 as shown in FIG. 2 is fixed to a motor shaft, and the motor (not shown in FIG. 2) is located inside a fan hub 2. The center 7 and the rotation axis 6 of the fan 5 are indicated in FIG. 2. Further, the fan 5 can be fixed to a frame of a fan module shown exemplary in FIG. 1.

Furthermore, the inventive fan 5, in particular an axial fan as shown in FIG. 2, comprises a plurality of fan blades 8. The fan blades 8 of the inventive fan 5 are attached at their lower end to the fan hub 2 and are further connected to one another at their upper end or tip 9 via an outer fan ring 10 similar to the fan described before with respect to FIG. 1.

In contrast to the conventional fan 5 and its fan blades 8 shown before in FIG. 1, the fan blades 8 of the inventive fan 5 are specially designed bi-sweep fan blades 8 to provide a particular bi-sweep fan 5 which will be described in the following in further detail.

As described before, a back sweep fan of a cooling fan module has good efficiency over a wider operating range and higher pressure rise at high flow rate compared to a forward sweep fan. However, a back sweep fan creates generally more noise.

An object of the invention is therefore to reduce fan noise and still keep high performance of a back sweep fan.

The leading edge of a back sweep fan directs airflow going radially outward along a blade leading edge of the fan blade, and flow accumulates at the intersection of the blade tip or upper end of the fan blade and the fan ring creates high stagnation pressure spot in that region.

Therefore the inventive fan 5 combines a back sweep fan and a forward sweep fan.

According to the invention the fan blades 8 of the inventive fan each form a back sweep fan blade with a forward sweep fan blade or forward sweep fan blade portion locally near the tip 9 or upper end of the fan blade 8. In other words, as shown in FIGS. 2, 3*a*, 3*b* and 4, the fan blade 8 comprises or consist of a lower or inner back sweep fan blade portion 12 and an upper or outer forward sweep fan blade portion 13.

The leading edge of forward sweep fan blade portion 13 directs airflow radially downwards along the fan blade leading edge 14 and prevents the buildup of high stagnation pressure near the fan blade tip 9 or upper end of the fan blade 8. This reduction of high stagnation pressure at the fan blade tip 9 contributes to a reduction of fan noise level. This forward sweep of the fan blade 8 quickly changed into back sweep, and most of the blade, e.g. at least up to 90%, is backward sweep to keep the high performance characteristic of the fan 5 over wide operating range. In other words, the lower back sweep portion 12 forms, e.g., 90% of the fan blade 8 and the forward sweep portion 13 thus forms, e.g., 10% of the fan blade 8, as shown in FIGS. 2 and 3.

Following Table 1 contains a non-dimensional blade definition. In Table 1 and as further indicated in FIGS. 3*a* and 3*b*, radius r indicates the radial location or local radius of a point of the fan blade edge, i.e. the fan blade leading edge 14 or a corresponding point of the fan blade trailing edge 15. In other words, radius r is for example the radial distance between a point, e.g. point 18 in FIG. 3*a*, on the leading edge 14 and the rotation axis 6 of the fan 5 and a radial distance between a corresponding point, e.g., point 17 in FIG. 3*a*, on the trailing edge 15 and the rotation axis 6 of the fan 5. Radius r can be therefore also used to indicate the radial location of a given blade section. A blade shape is defined by a series of blade sections from hub 2 to fan ring 10, in case a fan ring 10 is provided. An example of such a blade section is shown in following FIG. 4. The blade section shown in FIG. 4 comprises a camber mean line or mean line 16 with its two end points 17 and 18 having both the same local radius distance r and form the point 18 of the fan blade leading edge 14 and the point 17 of the fan blade trailing edge 15 of the blade section.

Radius R is the radius R of the upper end or blade tip 9 of the fan blade 8 which corresponds with the inner radius or inside radius of the fan ring 10, in case a fan ring 10 is provided, as shown in FIG. 3*c*.

Based on the ratio or quotient of r/R, a blade angle θ, a sweep angle T, a ratio or quotient of chord length/R, a ratio or quotient of camber length/chord length and a ratio or quotient of maximum blade thickness/chord length of a fan blade 8 is provided in Table 1. The camber length, the chord length, the blade angle θ and the maximum blade thickness are indicated in the cross section A-A of the fan blade in FIG. 4.

As can be derived from FIG. 4, the mean line 16 or camber mean line of the fan blade 8 is indicated by a dashed line. The two end points of the mean line 16 of the fan blade 8 are the point 18 of the leading edge and the point 17 of the trailing edge of the fan blade 8. The two points 17 and 18 have the same radial location r in FIG. 3*a* as pointed out before.

The chord length is distance between the two end points 17 and 18 of the mean line 16 of the fan blade 8, i.e. the point 18 of the leading edge 14 and the point 17 of the trailing edge 15 of the fan blade 8.

Further, the camber length is the maximum distance between chord and mean line 16. In FIG. 4 the maximum distance is not located at the center of the mean line.

Moreover, the maximum blade thickness as shown in FIG. 4 is the maximum thickness of the fan blade 8.

The blade angle θ is the angle between the mean line 16 of the fan blade 8 and a plane 20 which is perpendicular to the rotation axis 6 of the fan 5 and passes through point 18, wherein the mean line 16 and the plane 20 intersect at the point 18 of the leading edge 14 of the fan blade 8.

Furthermore, as shown in FIG. 3*a* the curvature of the leading edge of the fan blade can be described by the sweep angle or leading edge sweep angle T. The sweep angle T or leading edge sweep angle T is formed between a radial line $r_{18}$ through a point, i.e. point 18, on leading edge 14 of the fan blade 8 and a tangent 21 to leading edge 14 at said point, i.e. point 18. The radial line $r_{18}$ is a straight line between a point on leading edge, e.g. point 18, and the projection of said point on the fan rotation axis 6. The radial line $r_{18}$ is further perpendicular to the fan rotation axis 6.

As can be derived from Table 1 depending on the radial location r of a point of the fan blade leading edge and the resulting ratio or quotient r/R the blade angle θ, the sweep angle T, the ratio or quotient of the chord length/R, the ratio or quotient of the camber length/chord length and the ratio or quotient of maximum blade thickness/chord length of an embodiment of the inventive fan blade 8 is provided. However, the inventive fan can be described depending on the radial location r of a point of the fan blade leading edge and the resulting ratio r/R by at least one of the following parameters, namely the blade angle θ, the sweep angle T, the ratio of the chord length/R, the ratio of the camber length/chord length or the ratio of the maximum blade thickness/chord length as set out in Table 1 below.

TABLE 1

| Blade Definition | | | | | |
|---|---|---|---|---|---|
| r/R | Blade angle θ | Sweep angle T | Chord length/R | Camber length/chord length | Maximum blade thickness*/chord length |
| 0.373 | 16.4 | −2.7 | 0.171 | 0.053 | 0.069 |
| 0.442 | 11.8 | 0.1 | 0.172 | 0.050 | 0.069 |
| 0.512 | 8.4 | 4.5 | 0.172 | 0.047 | 0.069 |
| 0.582 | 5.6 | 13.2 | 0.171 | 0.046 | 0.070 |
| 0.651 | 3.2 | 24.3 | 0.169 | 0.044 | 0.070 |
| 0.721 | 1.3 | 34.7 | 0.165 | 0.043 | 0.072 |
| 0.791 | −0.2 | 42.5 | 0.160 | 0.042 | 0.074 |
| 0.861 | −1.4 | 48.6 | 0.153 | 0.042 | 0.078 |
| 0.930 | −1.9 | 51.6 | 0.144 | 0.041 | 0.085 |
| 0.956 | −3.9 | 0 | 0.137 | 0.042 | 0.089 |
| 1.00 | −16.2 | −35.6 | 0.106 | 0.041 | 0.111 |

The inventive fan 5 comprising fan blades 8, wherein each fan blade 8 consists of two different sweep portions, i.e., a lower or inner back sweep fan portion 12 and an upper or outer forward sweep portion 13. The fan blades 8 of the inventive fan 5 are defined in Table 1.

The inventive fan 5 has the advantage that a high performance fan can be provided over wide operating range with superior peak efficiency. A further advantage is that the inventive fan 5 provides a very flat torque over wide flow rate range which is highly desirable for high power brushless motor, and specially suite for very large size fan application.

Although the present invention has been fully described above by means of preferred embodiments, it is not limited to the above, but may be modified in a number of ways.

LIST OF REFERENCE NUMERALS

1 cooling fan module
2 fan hub
3 frame
4 opening
5 fan
6 rotation axis of fan
7 center of fan
8 fan blade
9 tip
10 fan ring
11 air gap
12 back sweep portion
13 forward sweep portion
14 leading edge
15 trailing edge
16 mean line
17 point of trailing edge
18 point of leading edge
20 plane perpendicular to the rotation axis of the fan intersect at the point of the leading edge of the fan blade
21 Tangent line of leading edge at point 18 of the leading edge

The invention claimed is:

1. A fan, the fan comprising:

a fan hub which comprises a fan rotation axis to rotate in a predetermined direction, a plurality of fan blades comprising a lower end and an upper end, wherein each fan blade is attached with its lower end to the fan hub and extends radially outwardly from the fan hub, wherein each fan blade comprises a lower back sweep portion and an upper forward sweep portion, wherein a maximum ratio r/R of the lower back sweep portion is at least 0.90, wherein r is the local radius of a point of a fan blade edge, and R is the radius of the upper end of the fan blade, wherein the ratio of camber length/chord length of the fan blade decreases from 0.053 to 0.041 from the lower end to the upper end of the fan blade, wherein the camber length is the maximum distance between chord and mean line at the radial location (r).

2. The fan of claim 1, wherein the maximum ratio r/R of the lower back sweep portion is less than or equal 0.95.

3. The fan of claim 2, wherein a blade angle (θ) of the fan blade decreases with increasing ratio r/R, wherein the blade angle (θ) is at least −16° at the upper end of the fan blade or at least 16° at the lower end of the fan blade, wherein the blade angle (θ) is the angle between the mean line of the fan blade and a plane which is perpendicular to the rotation axis of the fan, wherein the mean line and the plane intersect at the point of the fan blade leading edge at the radial location (r).

4. The fan of claim 1, wherein the ratio r/R of each fan blade is between 0.3 and 1.00.

5. The fan of claim 1, wherein the maximum sweep angle (T) of the leading edge of the fan blade is at least 50° or the minimum sweep angle (T) of the leading edge of the fan blade is at least −2.0°, wherein the sweep angle (T) is the angle between a radial line ($r_{18}$) through a point of the fan blade leading edge at the radial location (r) and a tangent to the leading edge at said point.

6. The fan of claim 1, wherein in the forward sweep region the sweep angle (T) of the leading edge of the fan blade ranges between T≤0° and T=−35.6°, and wherein the ratio r/R of the forward sweep region is between r/R≥0.956 and 1.00.

7. The fan of claim 1, wherein the ratio of maximum blade thickness/chord length of the fan blade increases with increasing ratio r/R and ranges from 0.069 to 0.111, wherein the ratio of the maximum blade thickness/chord length of the fan blade is 0.111 at the upper end of the fan blade, wherein the chord length is the distance between the point of the fan blade leading edge and the point of the fan blade trailing edge at the radial location (r), and wherein the maximum blade thickness is the maximum thickness of the fan blade at the radial location (r).

8. The fan of claim 1, wherein each blade has at least the parameters defined by

| r/R | Blade angle θ |
|---|---|
| 0.373 | 16.4 |
| 0.442 | 11.8 |
| 0.512 | 8.4 |
| 0.582 | 5.6 |
| 0.651 | 3.2 |
| 0.721 | 1.3 |
| 0.791 | −0.2 |
| 0.861 | −1.4 |
| 0.930 | −1.9 |
| 0.956 | −3.9 |
| 1.00 | −16.2 |

wherein r is the local radius of a point of the fan blade edge,

R is the radius of the upper end of the fan blade, and

θ is the blade angle between the mean line of the fan blade and a plane which is perpendicular to the rotation axis of the fan, wherein the mean line and the plane intersect at the point of the fan blade leading edge at the radial location r.

9. The fan of claim 1, wherein each blade has at least the parameters defined by

| r/R | Sweep angle T |
|---|---|
| 0.373 | −2.7 |
| 0.442 | 0.1 |
| 0.512 | 4.5 |
| 0.582 | 13.2 |
| 0.651 | 24.3 |
| 0.721 | 34.7 |
| 0.791 | 42.5 |
| 0.861 | 48.6 |
| 0.930 | 51.6 |
| 0.956 | 0 |
| 1.00 | −35.6 |

wherein r is the local radius of a point of the fan blade edge,

R is the radius of the upper end of the fan blade, and

T is the sweep angle between a radial line through the point of the fan blade leading edge at the radial location r and a tangent to leading edge at said point.

10. The fan of claim 1, wherein each blade has at least the parameters defined by

| r/R | Chord length/R |
|---|---|
| 0.373 | 0.171 |
| 0.442 | 0.172 |
| 0.512 | 0.172 |
| 0.582 | 0.171 |
| 0.651 | 0.169 |
| 0.721 | 0.165 |
| 0.791 | 0.160 |
| 0.861 | 0.153 |
| 0.930 | 0.144 |
| 0.956 | 0.137 |
| 1.00 | 0.106 |

wherein r is the local radius of a point of the fan blade edge,

R is the radius of the upper end of the fan blade, and chord length is the distance between the point of the fan blade leading edge and the point of the fan blade trailing edge at the radial location r.

11. The fan of claim 1, wherein each blade has at least the parameters defined by

| r/R | Chord length/R | Camber length/chord length |
|---|---|---|
| 0.373 | 0.171 | 0.053 |
| 0.442 | 0.172 | 0.050 |
| 0.512 | 0.172 | 0.047 |
| 0.582 | 0.171 | 0.046 |
| 0.651 | 0.169 | 0.044 |
| 0.721 | 0.165 | 0.043 |
| 0.791 | 0.160 | 0.042 |
| 0.861 | 0.153 | 0.042 |
| 0.930 | 0.144 | 0.041 |
| 0.956 | 0.137 | 0.042 |
| 1.00 | 0.106 | 0.041 |

wherein r is the local radius of a point of the fan blade edge,

R is the radius of the upper end of the fan blade, chord length is the distance between the point of the fan blade leading edge and the point of the fan blade trailing edge at the radial location r, and camber length is the maximum distance between chord and mean line at the radial location r.

12. The fan of claim 1, wherein each blade has at least the parameters defined by

| r/R | Chord length/R | Camber length/chord length | Maximum blade thickness/chord length |
|---|---|---|---|
| 0.373 | 0.171 | 0.053 | 0.069 |
| 0.442 | 0.172 | 0.050 | 0.069 |
| 0.512 | 0.172 | 0.047 | 0.069 |
| 0.582 | 0.171 | 0.046 | 0.070 |
| 0.651 | 0.169 | 0.044 | 0.070 |
| 0.721 | 0.165 | 0.043 | 0.072 |
| 0.791 | 0.160 | 0.042 | 0.074 |
| 0.861 | 0.153 | 0.042 | 0.078 |
| 0.930 | 0.144 | 0.041 | 0.085 |
| 0.956 | 0.137 | 0.042 | 0.089 |
| 1.00 | 0.106 | 0.041 | 0.111 |

wherein r is the local radius of a point of the fan blade edge,

R is the radius of the upper end of the fan blade, chord length is the distance between the point of the fan blade leading edge and the point of the fan blade trailing edge at the radial location r, camber length is the maximum distance between chord and mean line at the radial location r, and maximum blade thickness is the maximum thickness of the fan blade at radial location r.

13. The fan of claim 1, wherein each blade has the parameters defined by

| r/R | Blade angle θ | Sweep angle T | Chord length/R | Camber length/chord length | Maximum blade thickness/chord length |
|---|---|---|---|---|---|
| 0.373 | 16.4 | −2.7 | 0.171 | 0.053 | 0.069 |
| 0.442 | 11.8 | 0.1 | 0.172 | 0.050 | 0.069 |
| 0.512 | 8.4 | 4.5 | 0.172 | 0.047 | 0.069 |
| 0.582 | 5.6 | 13.2 | 0.171 | 0.046 | 0.070 |
| 0.651 | 3.2 | 24.3 | 0.169 | 0.044 | 0.070 |
| 0.721 | 1.3 | 34.7 | 0.165 | 0.043 | 0.072 |
| 0.791 | −0.2 | 42.5 | 0.160 | 0.042 | 0.074 |
| 0.861 | −1.4 | 48.6 | 0.153 | 0.042 | 0.078 |
| 0.930 | −1.9 | 51.6 | 0.144 | 0.041 | 0.085 |
| 0.956 | −3.9 | 0 | 0.137 | 0.042 | 0.089 |
| 1.00 | −16.2 | −35.6 | 0.106 | 0.041 | 0.111 |

wherein r is the local radius of a point of the fan blade edge,

R is the radius of the upper end of the fan blade,

θ is the blade angle between the mean line of the fan blade and a plane which is perpendicular to the rotation axis of the fan, wherein the mean line and the plane intersect at the point of the fan blade leading edge at the radial location r, T is the sweep angle between a radial line through the point of the fan blade leading edge at the radial location r and a tangent to leading edge at said point, chord length is the distance between the point of the fan blade leading edge and the point of the fan blade trailing edge at the radial location r, camber length is the maximum distance between chord and mean line at the radial location r, and maximum blade thickness is the maximum thickness of the fan blade at radial location r.

14. The fan of claim 1, wherein the fan comprises a fan ring connecting the fan blades at their upper end.

15. A fan module comprising a fan as claimed in claim 1.

16. The fan module of claim 15, wherein the fan module is a cooling fan module for a motor vehicle.

17. A fan, the fan comprising:

a fan hub which comprises a fan rotation axis to rotate in a predetermined direction, a plurality of fan blades comprising a lower end and an upper end, wherein each fan blade is attached with its lower end to the fan hub and extends radially outwardly from the fan hub, wherein each fan blade comprises a lower back sweep portion and an upper forward sweep portion, wherein a maximum ratio r/R of the lower back sweep portion is at least 0.90, wherein r is the local radius of a point of a fan blade edge, and R is the radius of the upper end of the fan blade, wherein the ratio of maximum blade thickness/chord length of the fan blade increases with increasing ratio r/R and ranges from 0.069 to 0.111, wherein the ratio of the maximum blade thickness/chord length of the fan blade is 0.111 at the upper end of the fan blade, wherein the chord length is the distance between the point of the fan blade leading edge and the point of the fan blade trailing edge at the radial location (r), and wherein the maximum blade thickness is the maximum thickness of the fan blade at the radial location (r).

18. A fan, the fan comprising:

a fan hub which comprises a fan rotation axis to rotate in a predetermined direction, a plurality of fan blades comprising a lower end and an upper end, wherein each fan blade is attached with its lower end to the fan hub and extends radially outwardly from the fan hub, wherein each fan blade comprises a lower back sweep portion and an upper forward sweep portion, wherein a maximum ratio r/R of the lower back sweep portion is less than or equal 0.95, wherein r is the local radius of a point of a fan blade edge, and R is the radius of the upper end of the fan blade, wherein a blade angle (θ) of the fan blade decreases with increasing ratio r/R, wherein the blade angle (θ) is at least −16° at the upper end of the fan blade or at least 16° at the lower end of the fan blade, wherein the blade angle (θ) is the angle between the mean line of the fan blade and a plane which is perpendicular to the rotation axis of the fan, wherein the mean line and the plane intersect at the point of the fan blade leading edge at the radial location (r).

* * * * *